US011255124B2

(12) United States Patent
Lee et al.

(10) Patent No.: US 11,255,124 B2
(45) Date of Patent: Feb. 22, 2022

(54) WINDOW SYSTEM PROVIDED WITH BLIND FOR SOLAR PHOTOVOLTAIC POWER GENERATION

(71) Applicant: LG HAUSYS, LTD., Seoul (KR)

(72) Inventors: Seung Jung Lee, Seoul (KR); Jong Tae Kim, Seoul (KR); Chul Jun Choi, Seoul (KR)

(73) Assignee: LG Hausys, Ltd., Seoul (KR)

( * ) Notice: Subject to any disclaimer, the term of this patent is extended or adjusted under 35 U.S.C. 154(b) by 206 days.

(21) Appl. No.: 16/633,715

(22) PCT Filed: Feb. 27, 2018

(86) PCT No.: PCT/KR2018/002376
§ 371 (c)(1),
(2) Date: Jan. 24, 2020

(87) PCT Pub. No.: WO2018/182182
PCT Pub. Date: Oct. 4, 2018

(65) Prior Publication Data

US 2020/0208466 A1 Jul. 2, 2020

(30) Foreign Application Priority Data

Mar. 29, 2017 (KR) ..... 10-2017-0039882

(51) Int. Cl.
*E06B 9/386* (2006.01)
*E06B 9/264* (2006.01)
(Continued)

(52) U.S. Cl.
CPC ..... *E06B 9/386* (2013.01); *E06B 9/264* (2013.01); *E06B 9/322* (2013.01); *E06B 2009/2476* (2013.01)

(58) Field of Classification Search
CPC .... E06B 9/386; E06B 9/38; E06B 2009/2476; E06B 9/364; E06B 2009/2643;
(Continued)

(56) References Cited

U.S. PATENT DOCUMENTS 4,011,700 A * 3/1977 Sado ..... E06B 9/04 52/235
4,513,552 A * 4/1985 Breithaupt ..... E06B 3/16 52/204.597
(Continued)

FOREIGN PATENT DOCUMENTS

JP 2007-231613 A 9/2007
KR 10-2012-0005311 A 1/2012
(Continued)

*Primary Examiner* — Daniel P Cahn
*Assistant Examiner* — Matthew R. Shepherd
(74) *Attorney, Agent, or Firm* — Dentons US LLP

(57) ABSTRACT

The present invention relates to a window system provided with a blind for solar photovoltaic power generation. In the window system of the present invention, a blind provided with solar cells is installed in a space between indoor side windows and outdoor side windows slidably coupled to the inner surfaces of a window frame. With such a configuration, the window system is easy to install and maintain. The window system of the present invention includes a window frame 10; indoor side windows 21 and outdoor side windows 23 slidably coupled to the inner surfaces of the window frame 10; and a blind 100 for solar photovoltaic power generation installed in a space S between the indoor side windows 21 and the outdoor side windows 23.

11 Claims, 10 Drawing Sheets

(51) Int. Cl.
*E06B 9/322* (2006.01)
*E06B 9/24* (2006.01)

(58) Field of Classification Search
CPC . E06B 9/264; E06B 9/26; E06B 9/266; E06B 9/28; E06B 9/323; E06B 2009/6827; E06B 3/4609; E06B 9/322; H02S 20/26; H02S 20/30; H02S 20/32; H01L 31/048; H01L 31/049
See application file for complete search history.

(56) References Cited

U.S. PATENT DOCUMENTS 4,841,697 A * 6/1989 Hogg ..... B32B 17/10036 52/208
5,743,970 A * 4/1998 Czubatjy ..... B29C 45/14639 136/251
2005/0189078 A1* 9/2005 Whiting ..... E06B 9/32 160/176.1 P
2008/0173698 A1* 7/2008 Marczi ..... H05K 3/341 228/180.1
2010/0154999 A1* 6/2010 Oh ..... E06B 9/322 160/7
2015/0240552 A1* 8/2015 Kim ..... E05D 15/0665 49/411
2015/0292258 A1* 10/2015 Pellini ..... B32B 27/08 428/34

FOREIGN PATENT DOCUMENTS

KR 10-2012-0037677 A 4/2013
KR 10-2014-0090436 A 7/2014
KR 10-1479124 A 8/2014
KR 10-1592403 B1 2/2016

* cited by examiner

【FIG. 1】
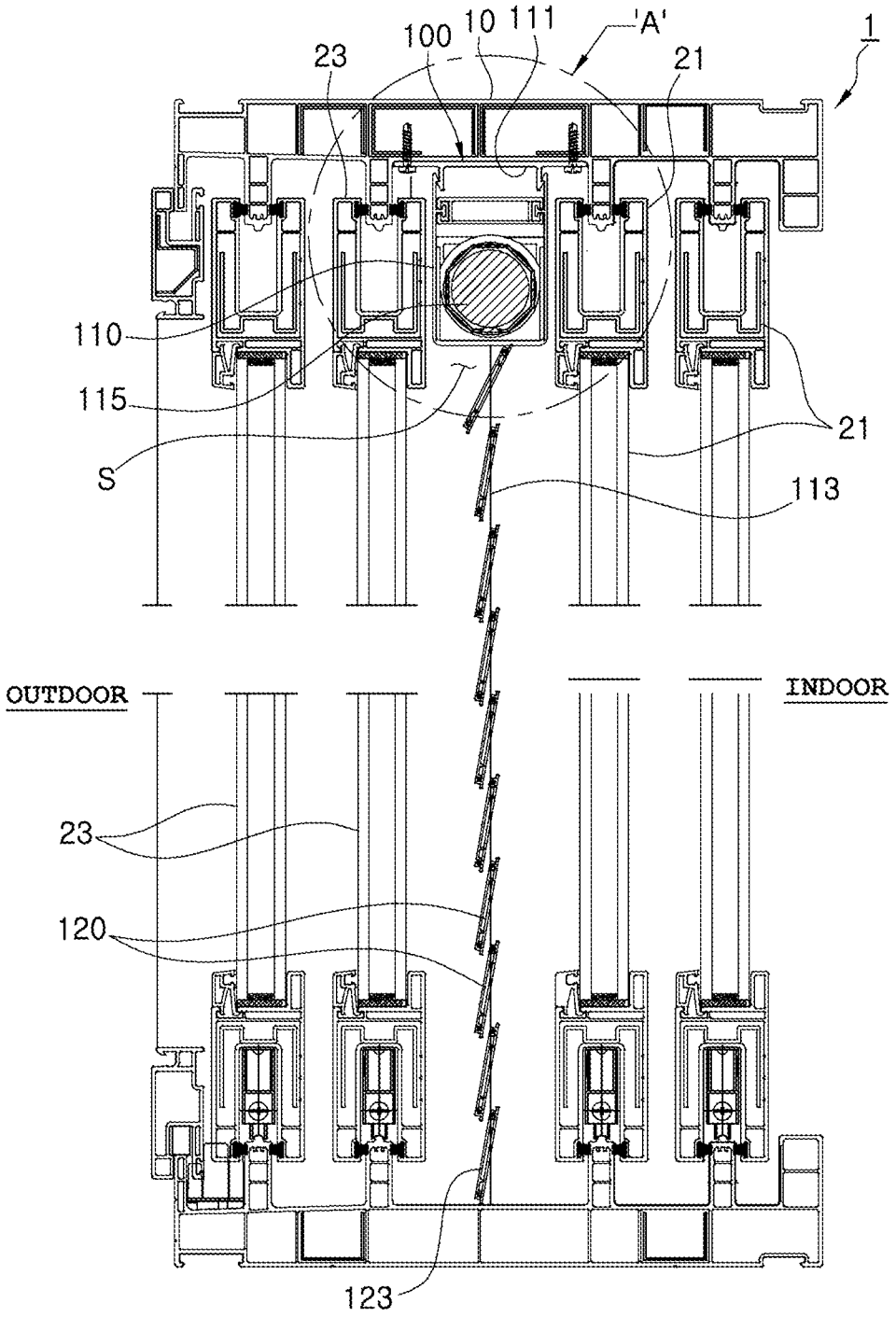

【FIG. 2】
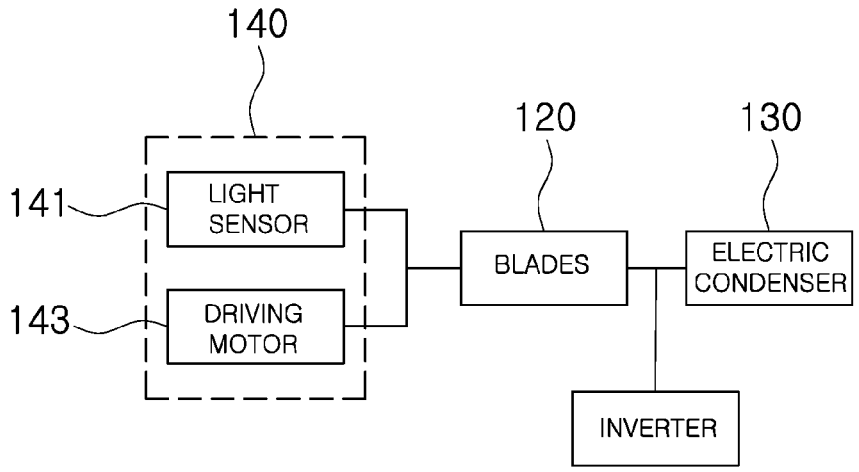
【FIG. 3】
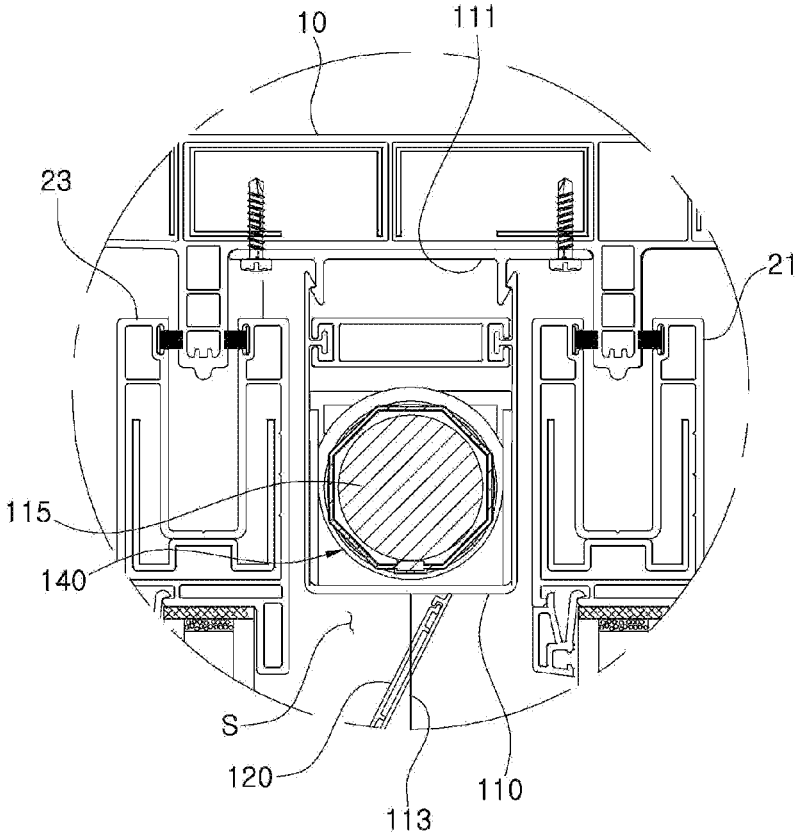

【FIG. 4a】
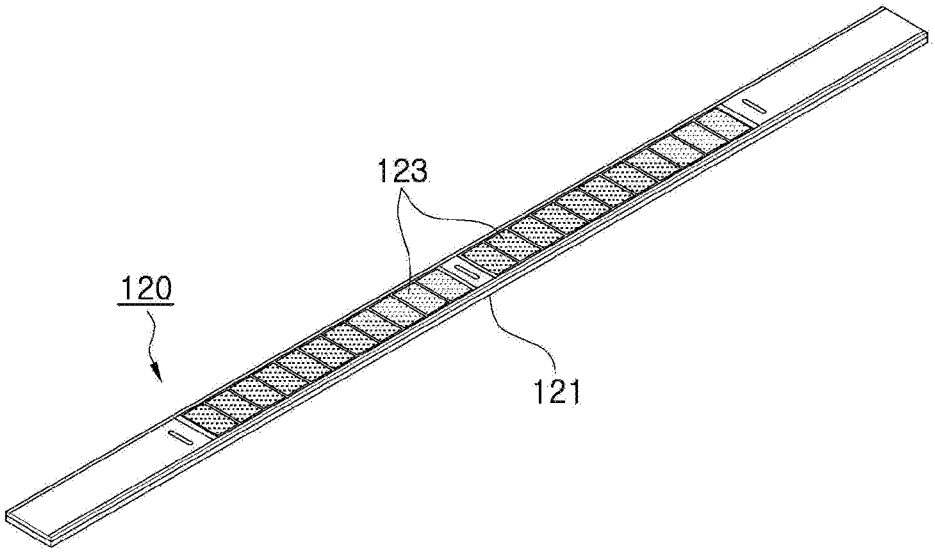
【FIG. 4b】
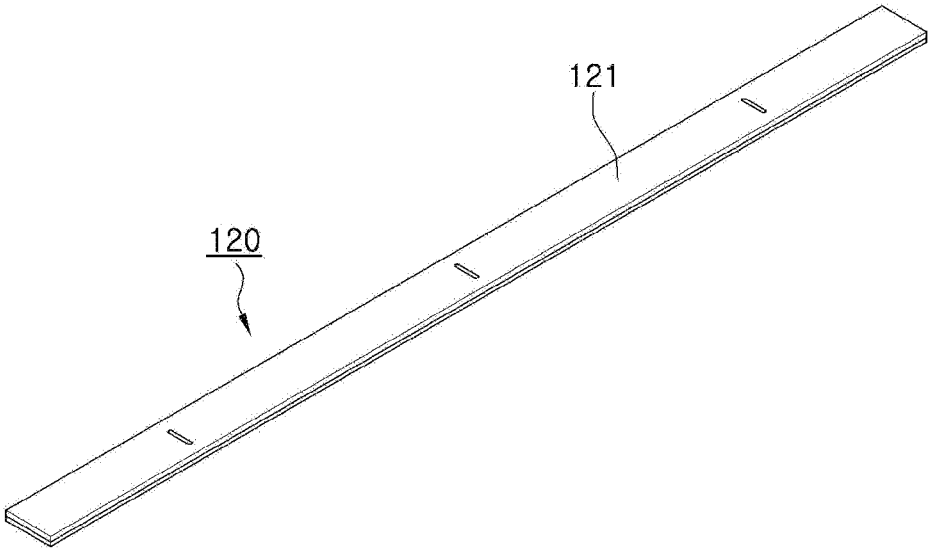

【FIG. 5】
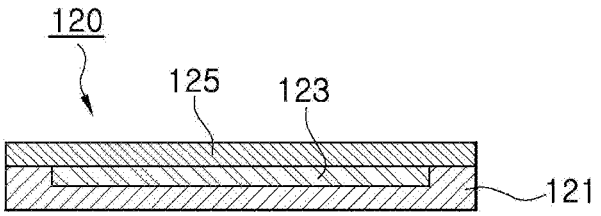
【FIG. 6】
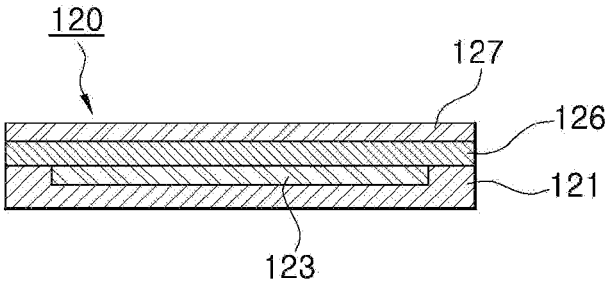
【FIG. 7】
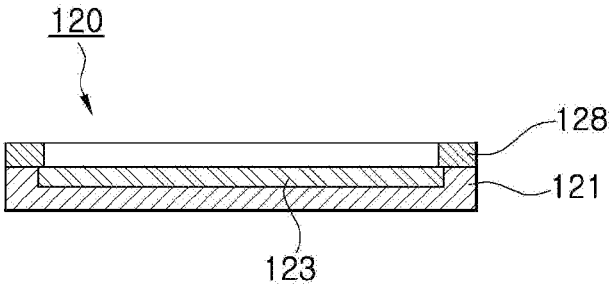

【FIG. 8】
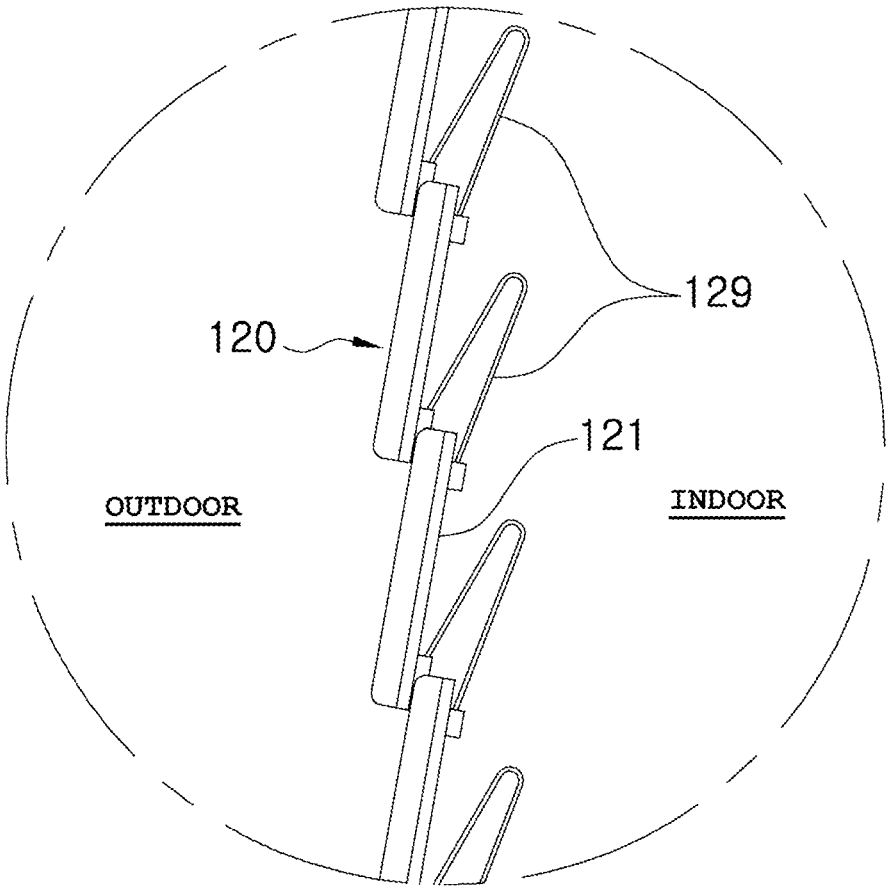

【FIG. 9】
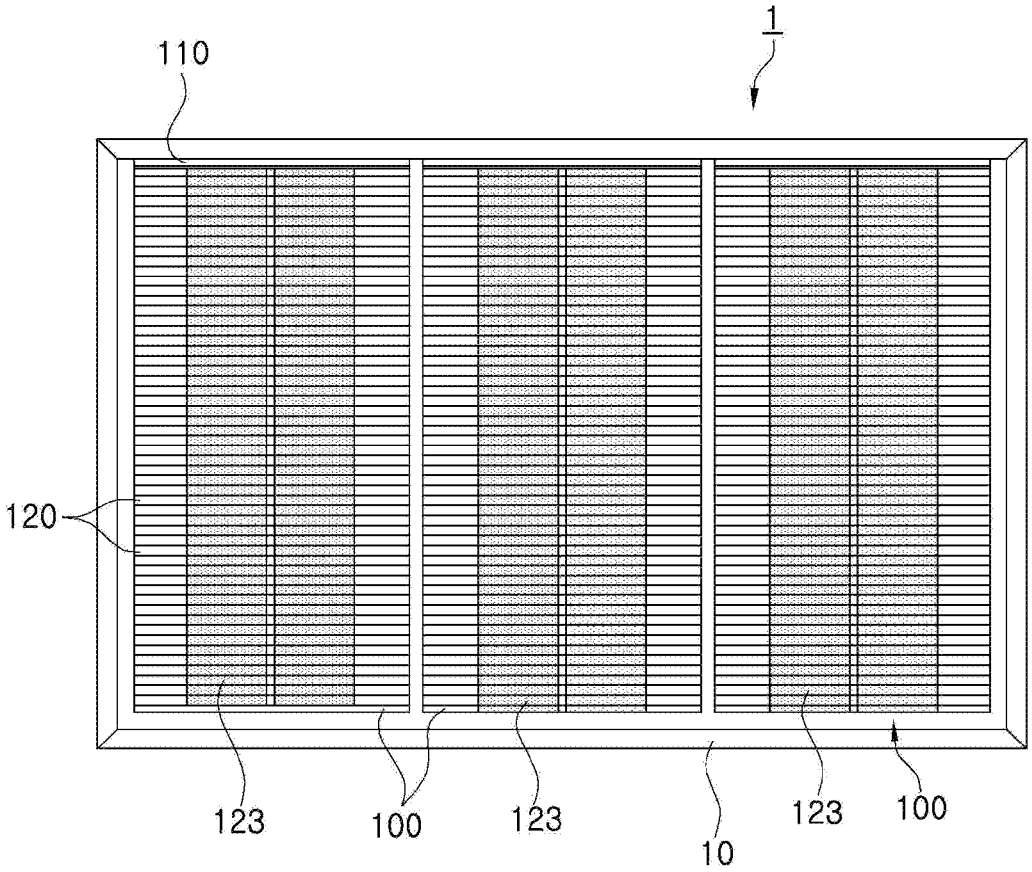

【FIG. 10】
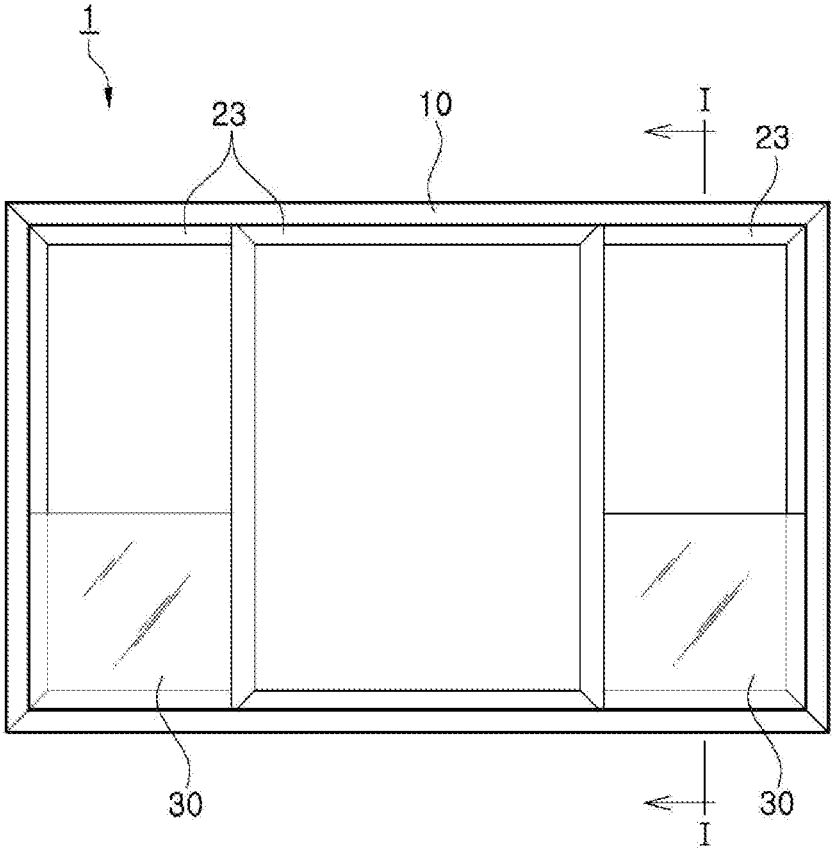

【FIG. 11】
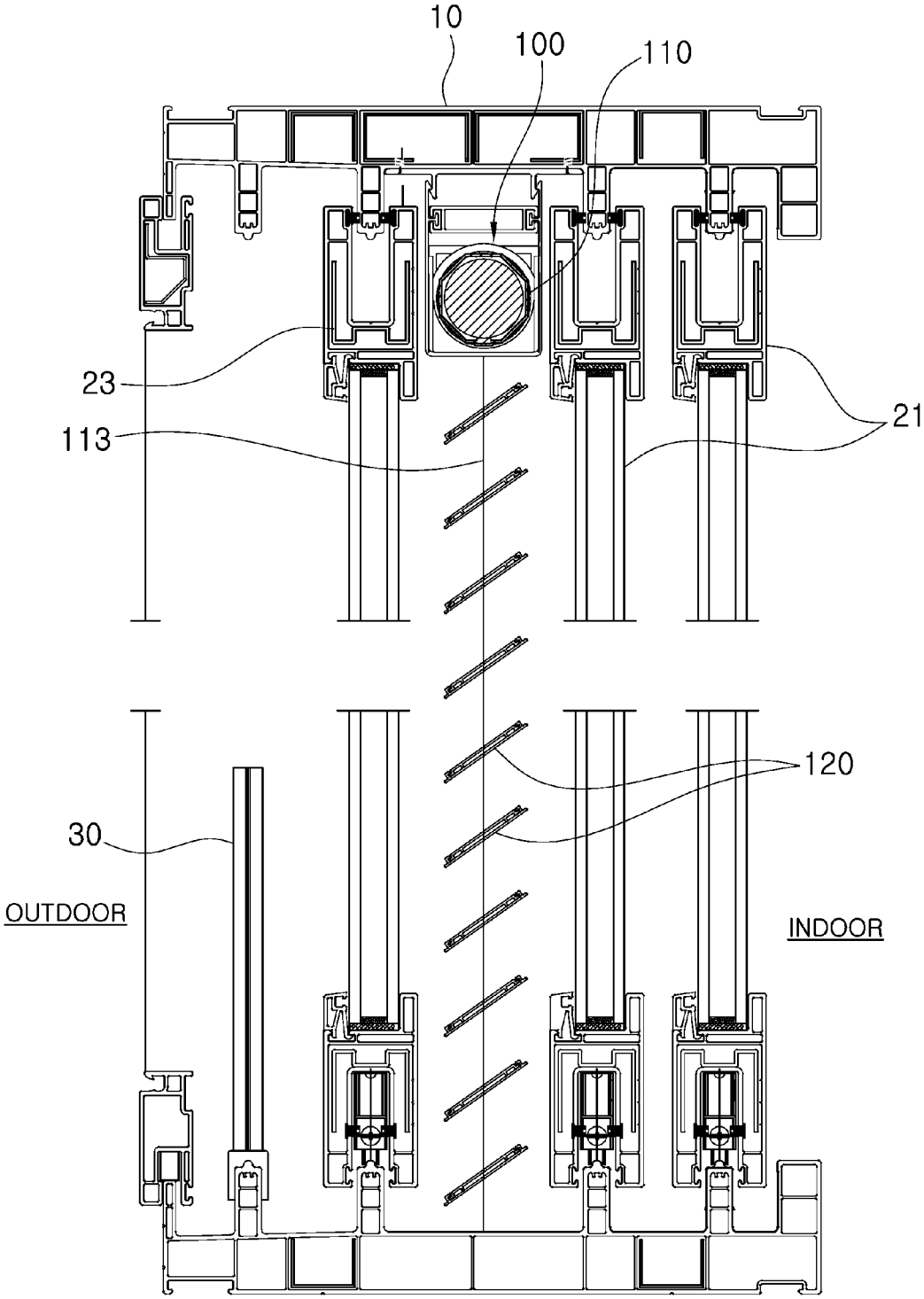

【FIG. 12】
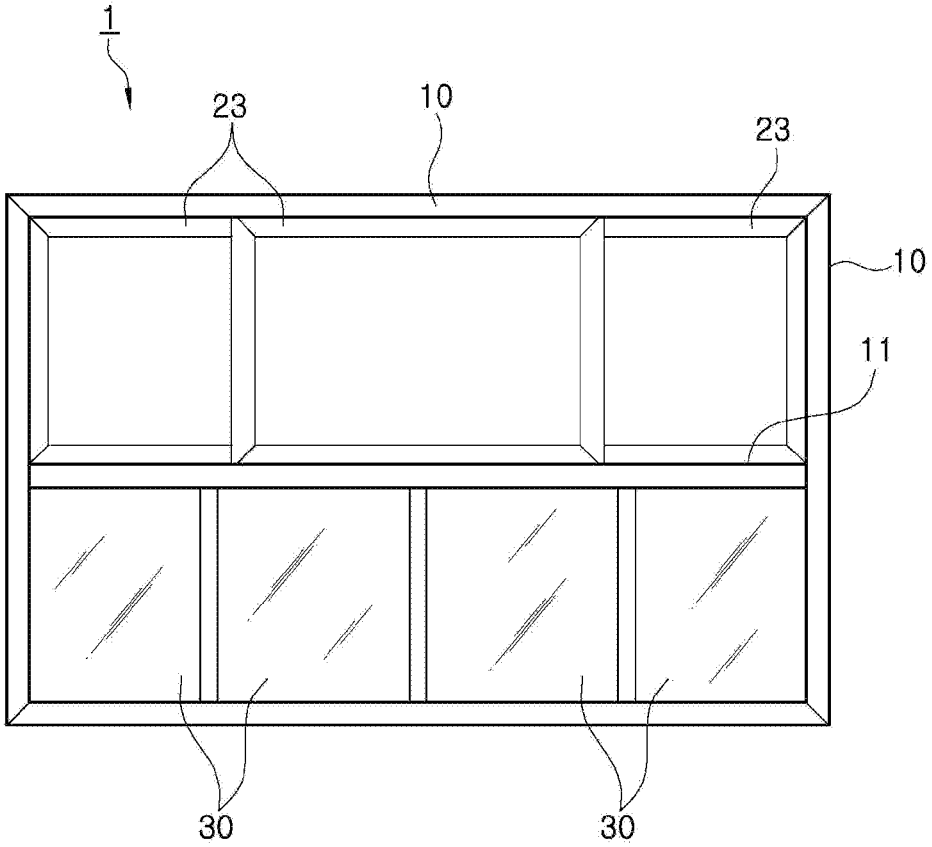

【FIG. 13】
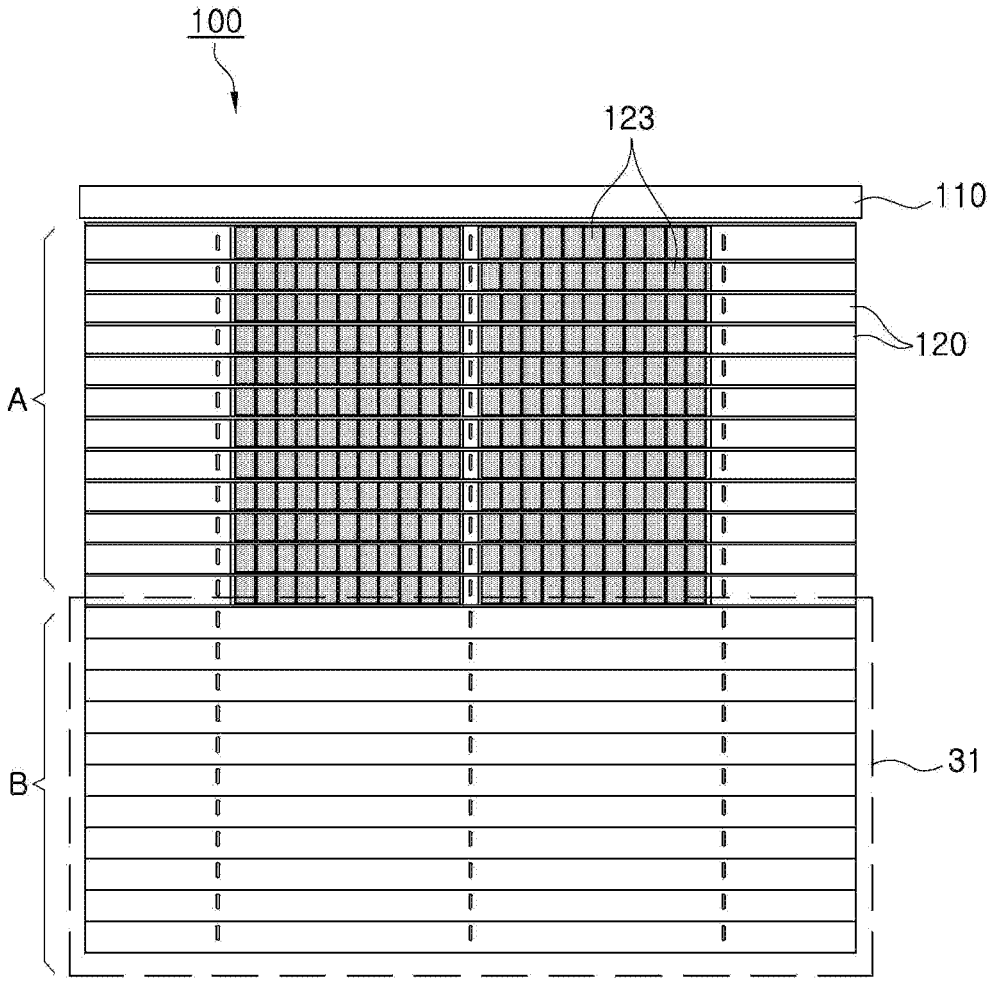

WINDOW SYSTEM PROVIDED WITH BLIND FOR SOLAR PHOTOVOLTAIC POWER GENERATION

This application is a National Stage Entry of International Application No. PCT/KR2018/002376, filed on Feb. 27, 2018, and claims the benefit of and priority to Korean Application No. 10-2017-0039882, filed on Mar. 29, 2017, all of which are hereby incorporated by reference in their entirety for all purposes as if fully set forth herein.

TECHNICAL FIELD

The present invention relates to a window system provided with a blind for solar photovoltaic power generation, and more particularly, to a window system having a configuration characterized in that a blind provided with solar cells is installed between double-pane windows. Through such a configuration, the window system of the present invention enables high efficiency solar photovoltaic power generation.

BACKGROUND ART

Recently, due to environmental pollution and depletion of fossil fuels, development of eco-friendly alternative energy sources and diversification of energy sources are emerging as international issues.

Accordingly, solar energy is attracting attention as an important alternative energy source, and interest in solar cells that convert sunlight into energy is increasing. In addition, with realization of low-cost solar cells, the scale of a global market associated with solar cells is rapidly increasing.

Along with this trend, a window system provided with a module for solar photovoltaic power generation that generates power using daytime sunlight has been proposed. For example, 'MICRO LOUVER-INTEGRATED WINDOW CAPABLE OF SOLAR PHOTOVOLTAIC POWER GENERATION' was disclosed in Korean Patent No. 10-1479124 (Publication date: Jan. 8, 2015).

Specifically, a conventional window system capable of solar photovoltaic power generation has a configuration in which multilayer glass panes are applied to a window so as to improve thermal insulation performance and a blind integrally provided with solar cells is installed in a sealed space between the multilayer glass panes.

However, in the conventional window system capable of solar photovoltaic power generation described above, a blind is installed in a confined space between multilayer glass panes. In this case, due to structural limitations, blind blades are inevitably formed narrowly, so that the amount of power generated is small.

In addition, since the blind is integrally formed between the multilayer glass panes of a window, maintenance may be difficult or impossible.

DISCLOSURE

Technical Problem

Therefore, the present invention has been made in view of the above problems, and it is one object of the present invention to provide a window system provided with a blind for solar photovoltaic power generation. In the window system of the present invention, a blind provided with solar cells is installed in a space between indoor side windows and outdoor side windows slidably coupled to the inner surfaces of a window frame. With such a configuration, the window system of the present invention is easy to install and maintain.

It is another object of the present invention to provide a window system provided with a blind for solar photovoltaic power generation capable of improving power generation efficiency by automatically operating the blind on a sunny day or during periods of high insolation.

Technical Solution

In accordance with one aspect of the present invention, provided is a window system including a window frame; indoor side windows and outdoor side windows slidably coupled to inner surfaces of the window frame; and a blind for solar photovoltaic power generation installed in a space between the indoor side windows and the outdoor side windows.

Advantageous Effects

In a window system of the present invention, a blind provided with solar cells is installed in a space between indoor side windows and outdoor side windows. With such a configuration, the window system of the present invention is easy to install and maintain.

In addition, the window system of the present invention includes an actuator for automatically operating the blind on a sunny day or during periods of high insolation, thereby improving power generation efficiency.

DESCRIPTION OF DRAWINGS

FIG. 1 is a side cross-sectional view of a window system provided with a blind for solar photovoltaic power generation according to the present invention.

FIG. 2 is a block diagram schematically showing the configuration of a blind for solar photovoltaic power generation according to the present invention.

FIG. 3 is a detailed view of part 'A' of FIG. 1 showing the installation structure of a blind according to the present invention.

FIGS. 4A and 4B illustrate the appearance of each of blades according to the present invention.

FIG. 5 is a cross-sectional view showing a laminated structure of each of blades according to one embodiment of the present invention.

FIG. 6 is a cross-sectional view showing a laminated structure of each of blades according to another embodiment of the present invention.

FIG. 7 is a cross-sectional view showing a laminated structure of each of blades according to still another embodiment of the present invention.

FIG. 8 is a detailed view showing a wiring structure for interconnecting blades according to the present invention.

FIG. 9 is an elevation view showing the outdoor side of a window system in which a blind for solar photovoltaic power generation according to the present invention is installed.

FIG. 10 is an elevation view showing the outdoor side of a window system provided with glass barriers in which a blind for solar photovoltaic power generation according to one embodiment of the present invention is installed.

FIG. 11 is a cross-sectional view taken along line I-I of FIG. 10.

FIG. 12 is an elevation view showing the outdoor side of a window system in which a blind for solar photovoltaic power generation according to another embodiment of the present invention is installed.

FIG. 13 is a drawing showing the outdoor side of a blind for solar photovoltaic power generation according to another embodiment of the present invention.

BEST MODE

Hereinafter, the functions or constructions of preferred embodiments of the present invention will now be described more fully with reference to the accompanying drawings.

Here, when reference numerals are applied to constituents illustrated in each drawing, it should be noted that like reference numerals indicate like elements throughout the specification.

FIG. 1 is a side cross-sectional view of a window system provided with a blind for solar photovoltaic power generation according to the present invention, FIG. 2 is a block diagram schematically showing the configuration of a blind for solar photovoltaic power generation according to the present invention, and FIG. 3 is a detailed view of part 'A' of FIG. 1 showing the installation structure of the blind.

Referring to FIG. 1, a window system 1 provided with a blind for solar photovoltaic power generation according to a preferred embodiment of the present invention includes a window frame 10, indoor side windows 21, outdoor side windows 23, and a blind 100 for solar photovoltaic power generation.

The configuration of the present invention will be described in detail as follows.

The window frame 10 constitutes the outer frame of the window system 1, and the top and bottom inside the window frame 10 are provided with a plurality of rails. In this case, the indoor side windows 21 and the outdoor side windows 23, which are each configured in pairs, are coupled to the rails so as to be openable/closable in a sliding manner.

In this case, a predetermined space S is provided between the indoor side windows 21 and the outdoor side windows 23 coupled in the window frame 10 so that the blind 100 for solar photovoltaic power generation (hereinafter referred to as 'blind') is installed therein.

Solar cells 123 (photovoltaic, PV) are disposed on one surface (the outdoor side of the window system) of the blind 100 installed in the space S between the indoor side windows 21 and the outdoor side windows 23, and the blind 100 serves to convert the light energy of sunlight entering the room through the outdoor side windows 23 into electric energy.

Referring to FIG. 2, the blind 100 includes a main body 110 fixed to the top inside the window frame 10; a plurality of blades 120 installed below the main body 110 and each having one side on which solar cells 123 are provided, wherein the blades 120 are connected via a driving line 113 and arranged to be spaced apart from each other; and an electric condenser 130 electrically connected to the blades 120 and responsible for storing electric energy generated by the solar cells 123.

In addition, the blind 100 may further include an inverter (not shown) electrically connected to the blades 120 and responsible for converting direct current electric energy generated by the solar cells 123 into alternating current electric energy.

Referring to FIG. 3, the main body 110 may be fitted in a snap-fit manner to a fixed bracket 111 installed on an upper side of the space S of the window frame 10. However, the present invention is not limited thereto, and a structure that allows easy and robust installation of the main body 110 may be used without particular limitation.

FIG. 4A is a perspective view showing the surface of each of the blades 120 provided with the solar cells 123, and FIG. 4B is a perspective view showing the bottom of the blade 120.

Referring to FIGS. 4A and 4B, the blades 120 are the key components of a blind for solar photovoltaic power generation, and are disposed so that the solar cells 123 installed on one surface of each of the blades 120 face the outdoor side.

Referring to FIG. 5, in one embodiment, the blade 120 may include a base layer 121 formed of any one of a printed circuit board (PCB), polyvinyl chloride (PVC), acrylic styrene acrylonitrile (ASA), aluminum, and wood; the solar cells 123 laminated on an upper portion of the base layer 121; and an epoxy resin layer 125 laminated and cured on upper portions of the solar cells 123 to surround the solar cells 123.

Referring to FIG. 6, according to another embodiment, in the blade 120, an ethylene-vinyl acetate (EVA) resin layer 126 instead of the epoxy resin layer 125 may be laminated on upper portions of the solar cells 123, and a polyethylene terephthalate (PET) film layer or thin glass layer 127 may be laminated on an upper portion of the EVA resin layer 126.

That is, to perform packing of the blade 120, the solar cells 123 are disposed on the base layer 121 constituting the main body of the blade 120, the EVA resin layer 126 serving as a mounting agent is laminated on upper portions of the solar cells 123, and the PET film layer or thin glass layer 127 serving as a cover sheet is laminated thereon.

Referring to FIG. 7, according to still another embodiment, the blade 120 may include an injection-molded cover 128 disposed on upper portions of the solar cells 123 to fix the positions of the solar cells 123. That is, the injection-molded cover 128 may be installed on the base layer 121 to surround one side or the edge of each of the solar cells 123 so that the solar cells 123 are exposed to the outside.

In this case, the solar cells 123 installed in each of the blades 120 are provided in plural and are connected in series. That is, the polarity of a solar cell is determined by the direction of light. The side of a solar cell directly receiving sunlight becomes a negative (−) electrode, and the opposite side becomes a positive (+) electrode. Accordingly, to connect a plurality of solar cells in series, the opposite sides of the solar cells should be connected to each other. The wiring structure for connecting the solar cells 123 is in accordance with a known technique, and thus detailed description thereof will be omitted.

Referring to FIG. 8, the blades 120 are connected via flexible printed circuit board (FPCB) wires 129 capable of being flexibly folded and unfolded. The FPCB wires 129 may be provided on one side of the other surface (indoor side) of each of the blades 120.

Referring back to FIGS. 1 and 2, an actuator 140 for automatically operating the blades 120 on a sunny day or during periods of high insolation is provided inside the main body 110.

Specifically, the actuator 140 may include a light sensor 141 for detecting the amount of sunlight and a driving motor 143 for rotating, in a forward or reverse direction, a winding roller 115 for winding the driving line 113 to automatically adjust folding/unfolding and angles of the blades 120 based on a signal detected by the light sensor 141.

However, the present invention is not limited thereto, and a user may manually operate the blind 100 according to the present invention.

In addition, the principle of adjusting folding/unfolding and angles of the blades 120 of the blind 100 using the driving line 113 is the same as the principle applied to a conventional blind, and thus description thereof will be omitted.

As shown in FIG. 9, the blind 100 may be disposed in the entire opening in the space S of the window frame 10.

In addition, referring to FIGS. 10 and 11, when the window system 1 provided with a blind for solar photovoltaic power generation according to the present invention is installed in an apartment balcony, glass barriers 30 may be provided on the outdoor side of the window frame 10 to prevent the power generation efficiency of the blind 100 from being reduced by the shadows of barriers provided in a balcony.

In one embodiment, instead of a conventional steel barrier, the glass barriers 30 may be installed on the outdoor side of the window frame 10 to prevent shadows from occurring at a lower portion of the opening of the window frame 10.

In another embodiment, as shown in FIG. 12, on the outdoor side of the window frame 10, an upper opening and a lower opening may be formed separately with respect to a transom 11. In this case, the outdoor side windows 23 may be slidably coupled to the upper opening, and the glass barriers 30 composed of laminated glass may be installed at the lower opening.

In still another embodiment, on the outdoor side of the window frame 10, a barrier 31 made of various materials (steel, synthetic resins, and the like) may be provided at a lower portion of the opening of the window frame 10. In this case, among the blades 120 arranged to be spaced apart from each other in the vertical direction in the opening of the window frame 10, only the blades 120 located in the upper portion of the opening where the barrier is not installed may be provided with the solar cells 123.

That is, as shown in FIG. 13, the solar cells 123 are not installed in the blades 120 located in a lower section B of an opening where a shadow may be generated due to the barrier 31, and the solar cells 123 are installed in only the blades 120 located in an upper section A of the opening where the shadow of the barrier 31 is not generated. With such a configuration, solar photovoltaic power generation efficiency may be improved.

As described above, in the window system 1 provided with a blind for solar photovoltaic power generation according to the present invention, the blind 100 provided with the solar cells 123 is disposed in the space S between the indoor side windows 21 and the outdoor side windows 23. Thus, the blind 100 is easy to install and maintain.

In addition, the actuator 140 including the light sensor 141 is provided inside the main body 110 so that the blind 100 operates automatically on a sunny day or during periods of high insolation, thereby improving power generation efficiency.

As described above, the present invention has been described with reference to certain preferred embodiments, but the present invention is not limited to the above-described embodiments, and various changes and modifications may be made without departing from the spirit of the present invention.

In particular, in the present invention, a case wherein the blind 100 for solar photovoltaic power generation is installed in the space S between the indoor side windows 21 and the outdoor side windows 23 has been described. However, the present invention is not limited thereto, and a case wherein the blind 100 is installed on the indoor side of the window frame 10 composed of single-pane or double-pane windows may be applied to the present invention.

In addition to the above-described window system, the blind 100 for solar photovoltaic power generation may be applied to a full window (an approximately 2-meter-high window installed on a veranda), a half window (an approximately 1-meter-high window installed on a main room or a second room), a window provided with glass barriers, or a window split into various patterns, such as a horizontally split window.

| Description of Symbols | |
|---|---|
| 1: WINDOW SYSTEM | 10: WINDOW FRAME |
| 11: TRANSOM | 21: INDOOR SIDE WINDOWS |
| 23: OUTDOOR SIDE WINDOWS | 30: GLASS BARRIERS |
| 31: BARRIER FORMED OF VARIOUS MATERIALS | |
| 100: BLIND FOR SOLAR PHOTOVOLTAIC POWER GENERATION | |
| 110: MAIN BODY | 111: FIXED BRACKET |
| 113: DRIVING LINE | 115: WINDING ROLLER |
| 120: BLADES | 121: BASE LAYER |
| 123: SOLAR CELLS | 125: EPOXY RESIN LAYER |
| 126: EVA RESIN LAYER | 127: PET FILM LAYER OR THIN GLASS LAYER |
| 129: FPCB WIRES | 130: ELECTRIC CONDENSER |
| 140: ACTUATOR | 141: LIGHT SENSOR |
| 143: DRIVING MOTOR | |

The invention claimed is:

1. A window system, comprising:

a window frame;

indoor side windows and outdoor side windows slidably coupled to inner surfaces of the window frame; and a blind for solar photovoltaic power generation installed in a space (S) between the indoor side windows and the outdoor side windows, wherein the blind comprises:

a main body fixed to an upper inside of the window frame;

a plurality of blades installed below the main body and each having one side on which solar cells are provided, wherein the blades are connected via a driving line and arranged to be spaced apart from each other; and an electric condenser electrically connected to the blades and responsible for storing electric energy generated by the solar cells, and wherein, on an outdoor side of the window frame, a barrier made of various materials is installed at a lower section (B) of an opening of the window frame; and among the blades arranged to be spaced apart from each other in a vertical direction in the opening of the window frame, only the blades located in an upper section (A) of the opening of the window frame where the barrier is not installed are provided with the solar cells and wherein the blades in the lower section where the barrier is installed do not have solar cells, and the barrier extends between two vertical members of the window frame.

2. The window system according to claim 1, wherein the blind further comprises an inverter electrically connected to the blades and responsible for converting direct current energy generated by the solar cells into alternating current energy.

3. The window system according to claim 1, wherein the main body is fitted in a snap-fit manner to a fixed bracket installed on an upper inner surface of the window frame.

4. The window system according to claim 1, wherein an actuator for automatically operating the blades on a sunny day or during periods of high insolation is provided inside the main body, wherein the actuator comprises a light sensor for detecting an amount of sunlight; and a driving motor for rotating, in a forward or reverse direction, a winding roller for winding the driving line to automatically adjust folding or unfolding and angles of the blades based on a signal detected by the light sensor.

5. The window system according to claim 1, wherein each of the blades comprises a base layer formed of any one of a printed circuit board (PCB), polyvinyl chloride (PVC), acrylic styrene acrylonitrile (ASA), aluminum, and wood;

the solar cells laminated on an upper portion of the base layer; and an epoxy resin layer laminated on upper portions of the solar cells.

6. The window system according to claim 1, wherein each of the blades comprises a base layer formed of any one of a printed circuit board (PCB), polyvinyl chloride (PVC), acrylic styrene acrylonitrile (ASA), aluminum, and wood;

the solar cells laminated on an upper portion of the base layer;

an ethylene-vinyl acetate (EVA) resin layer laminated on upper portions of the solar cells; and a polyethylene terephthalate (PET) film layer or thin glass layer laminated on an upper portion of the EVA resin layer.

7. The window system according to claim 1, wherein each of the blades comprises a base layer formed of any one of a printed circuit board (PCB), polyvinyl chloride (PVC), acrylic styrene acrylonitrile (ASA), aluminum, and wood;

the solar cells laminated on an upper portion of the base layer; and an injection-molded cover disposed on upper portions of the solar cells to fix positions of the solar cells.

8. The window system according to claim 1, wherein the blades are connected via flexible printed circuit board (FPCB) wires capable of being flexibly folded or unfolded.

9. The window system according to claim 1, wherein, the barrier is made of glass.

10. A window system, comprising:

a window frame;

single-pane or double-pane windows slidably coupled to inner surfaces of the window frame; and a blind for solar photovoltaic power generation installed at an indoor side of the window frame, wherein the blind comprises:

a main body fixed to an upper inside of the window frame;

a plurality of blades installed below the main body and each having one side on which solar cells are provided, wherein the blades are connected via a driving line and arranged to be spaced apart from each other; and an electric condenser electrically connected to the blades and responsible for storing electric energy generated by the solar cells, and wherein, on an outdoor side of the window frame, a barrier made of various materials is installed at a lower section (B) of an opening of the window frame; and among the blades arranged to be spaced apart from each other in a vertical direction in the opening of the window frame, only the blades located in an upper section (A) of the opening of the window frame where the barrier is not installed are provided with the solar cells, and wherein the blades in the lower section where the barrier is installed do not have solar cells, and the barrier extends between two vertical members of the window frame.

11. The window system according to claim 10, wherein the barrier is made of glass.

* * * * *